US006669062B1

(12) United States Patent
Laible

(10) Patent No.: US 6,669,062 B1
(45) Date of Patent: Dec. 30, 2003

(54) MULTI-PORT CAP ADAPTER FOR A LIQUID DISPENSING SYSTEM

(76) Inventor: Rodney Laible, 16315 Pawnee Rd., Bennington, NE (US) 68007

( * ) Notice: Subject to any disclaimer, the term of this patent is extended or adjusted under 35 U.S.C. 154(b) by 172 days.

(21) Appl. No.: 10/074,280

(22) Filed: Feb. 12, 2002

(51) Int. Cl.[7] ..... B67D 5/60

(52) U.S. Cl. ..... 222/464.1; 141/244; 251/149.6

(58) Field of Search ..... 222/464.1, 382, 222/189.01, 189.04, 189.11, 189.08, 527, 529, 482, 135, 518; 137/883, 854, 614.2, 590; 251/149.4, 149.6, 149.5; 141/236, 244, 346, 347, 384

(56) References Cited

U.S. PATENT DOCUMENTS

| | | | | | |
|---|---|---|---|---|---|
| 4,832,237 | A | * | 5/1989 | Hurford, Jr. | 222/464.1 |
| 4,948,014 | A | * | 8/1990 | Rutter et al. | 222/83 |
| 5,108,015 | A | * | 4/1992 | Rauworth et al. | 222/400.7 |
| 5,988,456 | A | | 11/1999 | Laible | |
| 6,142,345 | A | | 11/2000 | Laible | |
| 6,202,717 | B1 | * | 3/2001 | Markey et al. | 141/383 |

* cited by examiner

*Primary Examiner*—Gene Mancene
*Assistant Examiner*—Frederick Nicolas

(74) *Attorney, Agent, or Firm*—Thomte, Mazour & Niebergall; Dennis L. Thomte

(57) ABSTRACT

A multi-port cap dispenser for a liquid dispensing system including a liquid container which supplies liquid to a draw-off mechanism. A cap is removably mounted on the container for selectively closing the outlet opening thereof with the cap having a liquid passageway formed therein. The dip tube is fluidly connected to the lower end of the liquid passageway and extends downwardly into the liquid container. An adapter manifold is mounted on the upper end of the cap and has a plurality of discharge passageways formed therein which are in fluid communication with a, liquid compartment formed in the adapter manifold. The adapter manifold has a hollow take-off member positioned above each of the discharge passageways which is in fluid communication with the associated discharge passageways. Each of the hollow take-off members or ports have a dispensing tube secured thereto which extends to a draw-off mechanism such as a dispenser, mixing machine, etc. A normally closed, one-way check valve is positioned in each of the discharged passageways with the one-way check valves permitting fluid flow from the liquid compartment to the associated take-off member when in its open position. Each of the check valves prevents liquid-flow from the associated take-off member to the liquid compartment when in its closed position.

11 Claims, 3 Drawing Sheets

MULTI-PORT CAP ADAPTER FOR A LIQUID DISPENSING SYSTEM

BACKGROUND OF THE INVENTION

1. Field of the Invention

This invention relates to a liquid dispensing system and more particularly to a liquid dispensing system for dispensing corrosive liquid chemicals or dangerous medical liquid products which are typically drawn from a container, such as a bottle or the like, to a plurality of mixing machines or the like. Even more particularly, the invention relates to a multi-port cap adapter which is mounted on the liquid container and which has a pair of take-off members extending therefrom, each of which are in communication with a mixing machine or the like.

2. Description of the Related Art

Corrosive liquid chemicals and dangerous medical liquid products are typically contained in a container such as a bottle or the like and are frequently dispensed therefrom to a mixing machine. Applicant has previously received U.S. Pat. Nos. 5,988,456 and 6,142,345, each of which are entitled "CLOSED LOOP DISPENSING SYSTEM".

In applicant's earlier devices, a single take-off member is positioned at the upper end of the cap mounted on the container with a tube extending from the take-off member to a mixing machine. Although the devices of the above-identified patents work extremely well, it has been found that the inventions thereof have even greater capability and versatility if a pair of take-off members or ports are provided on the cap so that a single pick up tube in the container can provide two flow channels.

In applicant's U.S. Pat. No. 5,988,456, a closed loop dispensing system is disclosed which includes a cap portion having a single dispensing tube support provided thereon upon which is mounted a dispensing tube which extends to a draw-off mechanism such as a dispenser, mixing machine, etc. Applicant's U.S. Pat. No. 6,142,345 also discloses the structure described hereinabove.

Although the systems disclosed in the '456 and '345 patents have met with considerable success, those systems are limited in that they can only provide liquid to a single draw-off mechanism. The instant invention enables liquid from a single container to be supplied to a pair of draw-off mechanisms. Although the invention described herein provides liquid to a pair of draw-off mechanisms, it is possible that the cap adapter could have three or more take-offs provided thereon.

SUMMARY OF THE INVENTION

This invention relates to a dispensing system for use with a container, such as a bottle or the like, having an outlet opening formed in the upper end thereof. A cap is removably mounted on the container for selectively closing the outlet opening. The cap includes a liquid passageway formed therein which has upper and lower ends. A dip tube is operatively fluidly connected to the lower end of the liquid passageway which extends downwardly into the liquid container. An adapter manifold is provided on the upper end of the cap and has a liquid compartment formed therein which is in fluid communication with the upper end of the liquid passageway in the cap. The adapter manifold has a pair of discharge passageways formed therein which are in fluid communication with the liquid compartment. The adapter manifold has a hollow take-off member above each of the discharge passageways which is in fluid communication with the associated discharge passageway. Each of the hollow take-off members are adapted to have a discharge tube secured thereto which extends to a mixing machine or the like which draws liquid thereinto by suction. A normally closed, one-way check valve is positioned in each of the discharge passageways which is movable between open and closed positions. Each of the one-way check valves permits liquid flow from the liquid compartment to the associated take-off member when in its open position. Each of the one-way check valves prevents liquid flow from the associated take-off member to the liquid compartment when in its closed position. Each of the check valves comprises a flexible, disc-shaped valve member. Preferably, a metering orifice is positioned in each of the take-off members. Although a pair of take-off members and a pair of check valves are described, it is possible that three or more take-off members and check valves could also be utilized.

It is therefore a principal object of the invention to provide an improved dispensing system for corrosive or dangerous liquids contained in a container such as a bottle or the like.

A further object of the invention is to provide a dual-port cap adapter for a liquid dispensing system which enables liquid from a single container to be supplied to a pair of mixing machines or the like.

Yet another object of the invention is to provide a multi-port cap adapter for a liquid dispensing system including a plurality of hollow take-off members, each of which have a metering orifice positioned therein.

These and other objects will be obvious to those skilled in the art.

DESCRIPTION OF THE PREFERRED EMBODIMENT

Figure 2:
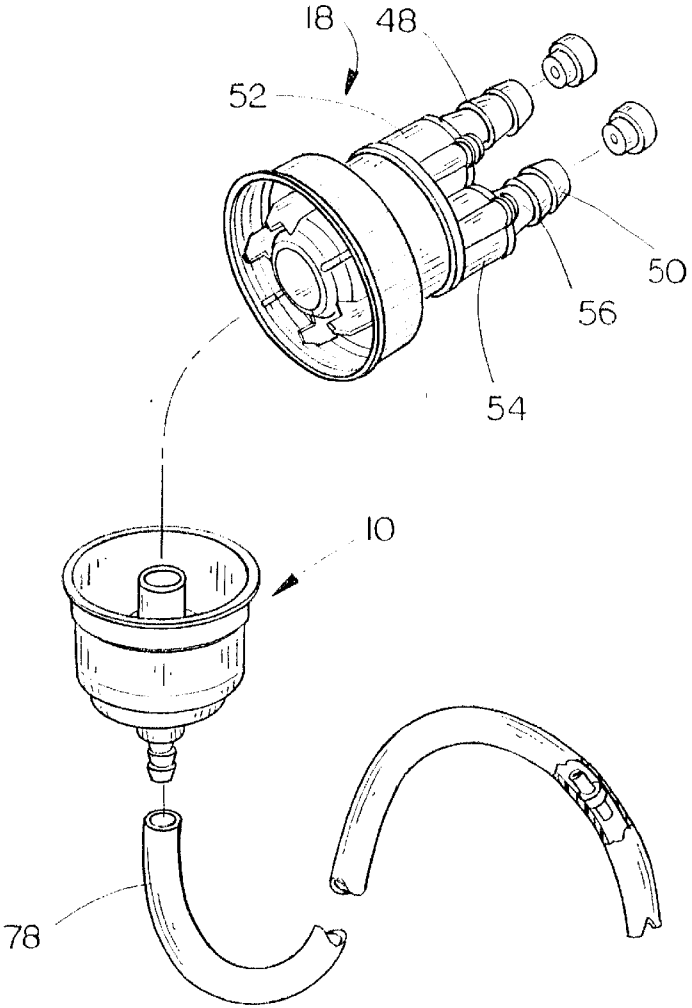
FIG. 2 is an exploded perspective view of the invention.
Figure 1:
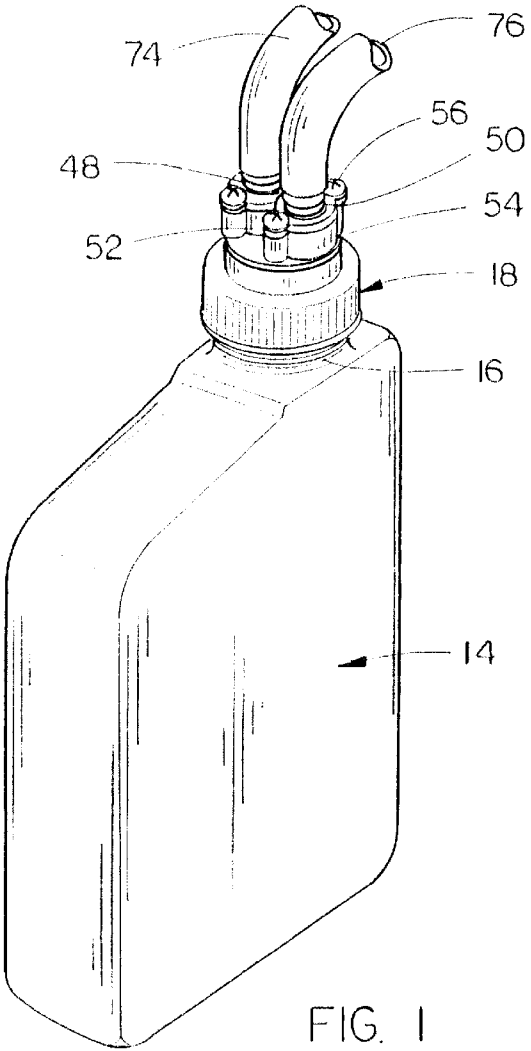
FIG. 1 is a perspective view of a liquid container having the multi-port cap adapter of this invention mounted thereon.
Figure 3:
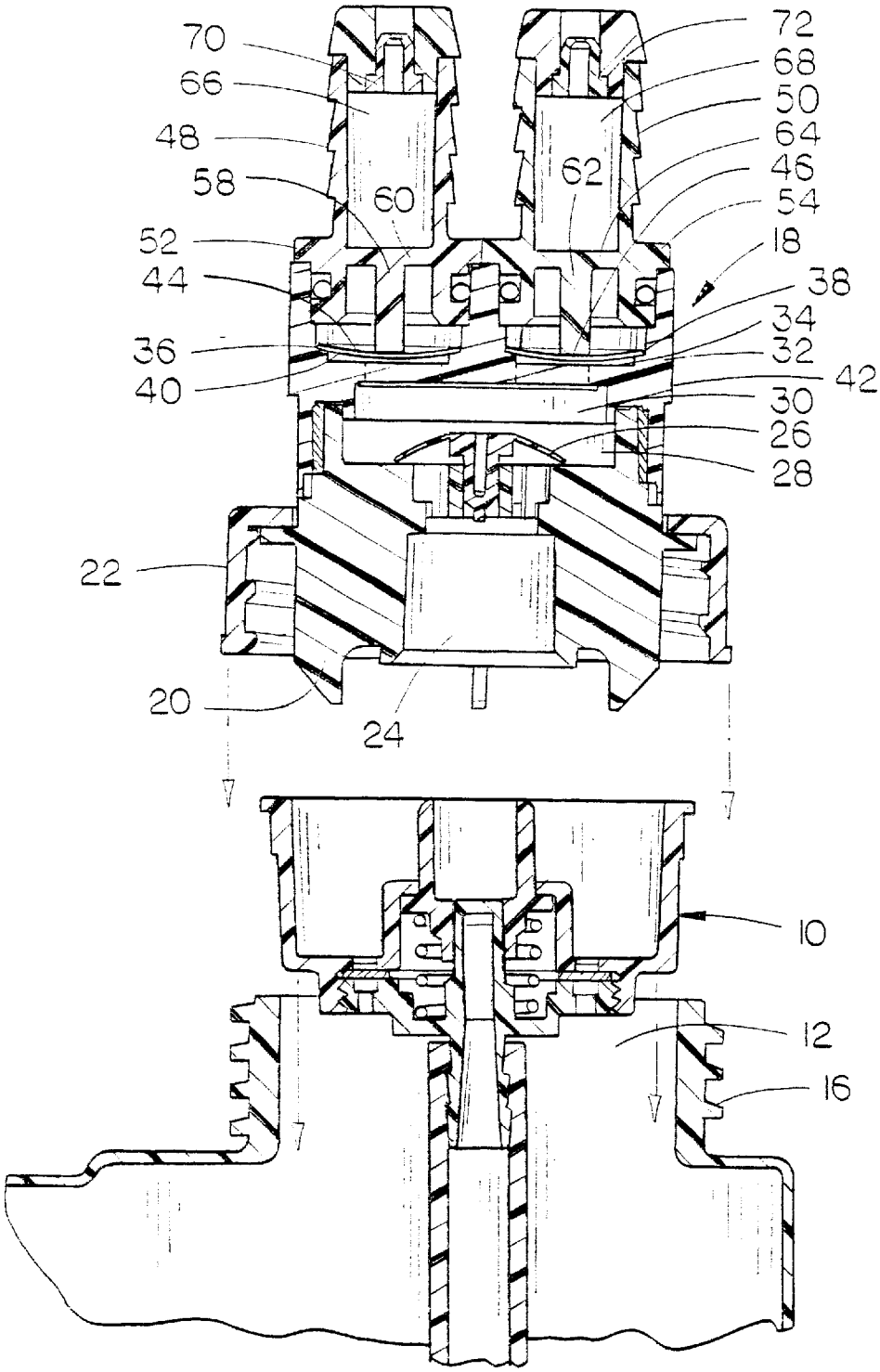
FIG. 3 is a vertical sectional view taken through the container and the multi-port cap adapter.
Figure 4:
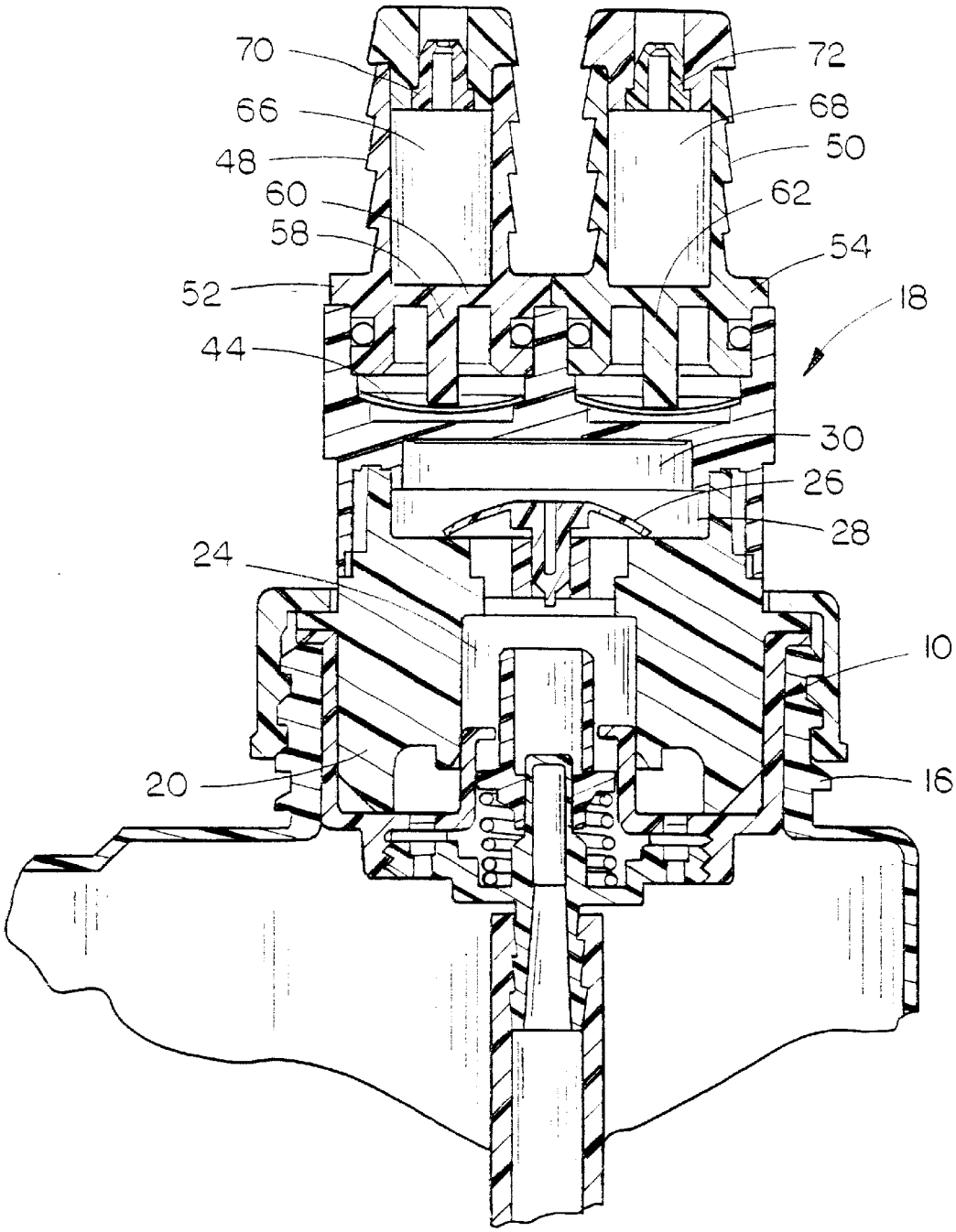
FIG. 4 is a sectional view similar to FIG. 3 except that the cap adapter is mounted on the container.

In the drawings, the numeral 10 refers to a throat plug assembly which is press-fitted into the throat or outlet opening 12 of a container 14 such as a bottle or the like. Preferably, throat 12 includes external threads 16. Assembly 10 of this invention is preferably similar to the throat plug assembly described in the '456 and '345 patents although the invention herein will perform satisfactorily with other throat plug assemblies. In fact, the invention herein will perform satisfactorily with those dispensing systems wherein throat plug assemblies are not used at all.

The numeral 18 refers to the cap adapter of this invention which is adapted to be mounted on the throat of the container to supply liquid to at least a pair of draw-off mechanisms such as dispensers, mixing machines, etc. Adapter 18 includes a bottom housing 20 having an internally threaded retainer collar 22 rotatably mounted thereon. Collar 22 is adapted to be threadably mounted on threads 16 of the throat 12. A central passageway 24 extends upwardly into the bottom housing 20 with the upper end thereof being normally closed by a one-way check valve in the form of an umbrella check valve 26 which prevents back flow into the container in conventional fashion. Compartment 28 is formed in the upper end of bottom housing 20, as seen in the drawings, and is in fluid communication with a compartment 30 formed in the lower end of adapter top housing 32 which is secured to the upper end of bottom housing 20 and which extends upwardly therefrom.

Compartment 30 is in fluid communication with compartment 34 formed in adapter top housing 32. The upper end of compartment 34 is closed except for a pair of circular valve openings 36 and 38 having annular shoulders 40 and 42 extending therearound, respectively. Flexible, disc-shaped check valves 44 and 46, constructed of Neoprene or other suitable chemical-resistant material, are positioned on annular shoulders 40 and 42, respectively, to normally close valve openings 36 and 38, respectively.

The numerals 48 and 50 refer to adapter take-offs which are removably mounted on the upper ends of cylindrical portions 52 and 54, respectively, by screws 56. Adapter take-off 48 includes a post 58 which extends downwardly from a spoke-shaped support 60 for engagement with the center of the check valve 44. Similarly, adapter take-off 50 includes a post 62 which extends downwardly from a spoke-shaped support 64 for engagement with the center of the check valve 46. Take-offs 48 and 50 include hollow tubular portions 66 and 68, the upper ends of which removably receive metering tips or orifices 70 and 72, respectively. Dispensing tubes 74 and 76 are mounted on take-offs 48 and 50 and extend to separate draw-off mechanisms such as dispensers, mixing machines, etc. If a throat plug assembly 10 is utilized, a dip tube 78 would extend therefrom downwardly into the liquid container in conventional fashion. If a throat plug assembly is not utilized, the upper end of the dip tube 78 is placed into fluid communication with the compartment 24 by any convenient means.

In use, the retaining collar 22 is screwed onto the threads 16 of the container 14 so that the upper end of the dip tube is either in fluid communication with the throat plug assembly 10, if used, or with the compartment 24 as described above. The metering tips or orifices 70 and 72 are mounted in the upper ends of the take-offs 48 and 50 if not previously installed. The metering tips 70 and 72 each control the volume of liquid leaving the bottom and could be the same size or different sizes. For example, tip 70 could have an internal bore sized to provide a 200:1 ratio while tip 72 could have an internal bore sized to provide a 12:1 ratio.

Assuming that the draw-off mechanism fluidly connected to take-off 48 is activated, the draw-off mechanism will create a suction within dispensing tube 74 which will cause the periphery of valve 44 to unseat from shoulder 40 with the center of valve 44 being held in place by the post 58. Liquid is drawn upwardly through the dip tube 78, through the throat assembly 10 if such is being utilized, through compartment 24, through valve 28 into compartment 28, through compartment 30, into compartment 36, around valve 44, upwardly through take-off 48, through metering tip 70, and through the dispensing tube 74 to the draw-off mechanism connected thereto. At the same time, the suction in compartment 30 and compartment 38 will cause the periphery of valve 46 to tightly seal against the shoulder 42 so that liquid cannot pass through take-off 50. If the draw-off mechanism connected to dispensing tube 76 is activated at the same time as the draw-off mechanism connected to dispensing tube 74 is activated, liquid will be supplied to both of the draw-off mechanisms in the ratios determined by the metering tips 70 and 72.

As seen, the cap adapter of this invention is a screw-on rotating collar which opens the moving valve on the throat plug assembly. The threads of the cap and the bottle are utilized to maintain a sealed connection between the cap adapter and the throat plug assembly. It is important to note that a maintained connection can be done many ways and styles depending on the intended customer's desired use. As previously stated, the cap adapter itself can have a dip tube or pick-up tube extending downwardly into the bottle which is not mated to a throat plug assembly while still functioning the same.

The instant invention represents a significant advance from the single port adapters of the prior art in that the dual take-off ports which are connected to draw-off mechanisms, a single pick-up tube or dip tube in the container can provide two flow channels. As suction is applied to one port to draw product from the container, that same suction maintains the other check valve in the closed position to seal any air from coming back into the chamber that is pulling the product out. When no suction is applied, both valves reseal the exit ports and product will not return from the dispensing tubes into the bottle, thereby causing the system to lose prime.

A metering orifice of different size can be mounted in each of the discharge ports to control the volume of product leaving the bottle port. As stated, each port can be the same or different size based on the requirements of the customer. In this way, dual mixtures from a single bottle are provided which reduces the number of bottles in the work area and reduces the expenditure of dual mixing machines. Inasmuch as dilution rate calculations are substantially reduced through this invention, the chances of making a toxic mistake by untrained work force members is reduced. As stated, although dual ports or take-offs are described herein, any number of ports could be utilized if so desired.

Thus it can be seen that the invention accomplishes at least all of its stated objectives.

I claim:

1. In combination:

a liquid container having upper and lower ends;

said container having an outlet opening formed in its upper end;

a cap, having upper and lower ends, removably mounted on said container for selectively closing said outlet opening;

said cap having a liquid passageway formed therein which has upper and lower ends;

a dip tube operatively fluidly connected to said liquid passageway which extends downwardly into the liquid container;

an adapter manifold on the upper end of said cap;

said adapter manifold having a plurality of discharge passageways formed therein which are in fluid communication with said liquid passageway in said cap;

said adapter manifold having a hollow take-off member above each of said discharge passageways which is in fluid communication with the associated discharge passageway;

each of said hollow take-off members adapted to have a dispensing tube secured thereto which extends to a draw-off mechanism which draws liquid thereinto by suction;

a normally closed, one-way check valve in each of said discharge passageways which is movable between open and closed positions;

each of said one-way check valves permitting liquid flow from said liquid passageway to the associated take-off member when in its said open position;

each of said one-way check valves preventing liquid flow from the associated take-off member to said passageway when in its said closed position.

2. The combination of claim 1 wherein each of said check valves comprises a flexible, disc-shaped valve member.

3. The combination of claim 2 wherein a retainer is positioned above each of said disc-shaped valve members which engages the center of the associated valve member to limit the upward movement of the center of the valve member when the valve member is in its said open position.

4. The combination of claim 1 including a metering orifice in at least one of said take-off members.

5. The combination of claim 1 further including a metering orifice removably positioned in at least one of said take-off members.

6. The combination of claim 1 further including a metering orifice in each of said take-off members.

7. The combination of claim 1 wherein said cap has a liquid compartment having inlet and discharge sides; said liquid compartment being in fluid communication with said liquid passageway and said discharge passageways.

8. The combination of claim 7 wherein said cap includes an umbrella valve which is positioned below said liquid compartment which is movable between open and closed positions; said umbrella valve, when in its open position, permitting liquid flow from said container into said liquid compartment; said umbrella valve, when in its closed position, preventing liquid flow from said liquid compartment to said container.

9. The combination of claim 7 wherein a filter screen extends across said discharge side of said liquid compartment.

10. The combination of claim 3 wherein each of said disc-shaped valve members are peripheral mounted on an annular shoulder.

11. The combination of claim 2 wherein each of said discharge passageways defines an annular shoulder which supports the periphery of the associated valve member.

* * * * *